United States Patent [19]

Pipes

[11] Patent Number: 5,005,681

[45] Date of Patent: Apr. 9, 1991

[54] BRAKE MECHANISM FOR A STORAGE AND RETRIEVAL MACHINE

[75] Inventor: George R. Pipes, Salt Lake City, Utah

[73] Assignee: Eaton-Kenway, Inc., Salt Lake City, Utah

[21] Appl. No.: 454,788

[22] Filed: Dec. 20, 1989

[51] Int. Cl.[5] ..... B66B 5/16; B66B 9/20

[52] U.S. Cl. ..... 192/7; 192/8 A; 192/1.37; 187/9 R

[58] Field of Search ..... 192/7, 8 R, 8 A, 1.36, 192/1.37, 1.39; 187/9 R, 73

[56] References Cited

U.S. PATENT DOCUMENTS 4,603,594 8/1986 Grimm ..... 192/1.37

*Primary Examiner*—Allan D. Herrmann

*Assistant Examiner*—Andrea Pitts

*Attorney, Agent, or Firm*—F. M. Sajovec

[57] ABSTRACT

An overtravel brake system for a storage and retrieval system which is automatically actuated when the load carriage lift motor is deenergized and the load carriage moves downward. The brake system includes a dog mounted on the load carriage and engageable with the mast, the dog being actuated by a chain or cable which applies an actuating force to the dog actuating mechanism only after the load carriage has traveled a predetermined distance. The chain or cable is connected to the output member of a clutch mechanism operable in response to relative movement between the load carriage and the mast, and which is held in a disengaged condition when the lift motor is energized and is automatically shifted to an engaged condition when the lift motor is deenergized.

11 Claims, 3 Drawing Sheets

BRAKE MECHANISM FOR A STORAGE AND RETRIEVAL MACHINE

The present invention relates to storage and retrieval (S/R) machines, and more particularly to a brake mechanism for such machines.

High rise storage and retrieval machines typically include safety brake mechanisms which prevent the load carriage or load platform of the machine from falling in the event of a failure of the vertical lifting system of the machine. Such systems also include brake systems, typically associated with the vertical drive motor, which operate to hold a load in a given stopped position under normal operating conditions. When a motor brake is used for normal load holding it is possible for the motor brake to slip somewhat, for example if it is not optimally adjusted, causing the load to drift downward from its stopped position. Since most safety brakes are designed to actuate upon sudden acceleration and/or an overspeed condition such as that caused by lift cable breakage or total failure of the motor brake, such drifting movement will not cause the safety brake to actuate; however, it is desirable to limit the extent of such drift or overtravel.

The present invention provides a brake actuating mechanism which is operable to prevent the downward drifting of a load in the event that the motor brake is not effective to hold the load stationary but which does not undergo a complete failure which would cause the safety brake to actuate. More specifically, the present invention provides a mechanism which actuates the existing safety brake mechanism in the event of a drift condition, but which does not affect the operation of the safety brake system in the event of a catastrophic failure of the vertical lift system.

The safety brake is mounted on the load carriage and is driven by a chain extending the length of the mast and engaged with a sprocket on an input member of the safety brake. The output member of the safety brake is engaged by centrifugal weights on the input member when a predetermined speed representing an overspeed condition is reached. Rotation of the output member trips a pivoting dog which engages the mast to stop further travel of the load carriage. The present invention includes a clutch having an input member also engaged with the safety brake chain, and an output member which includes a flexible member such as a chain or cable connected to the output member of the safety brake. The clutch is normally engaged and is held in a disengaged condition during normal machine operations by means of a solenoid which is engaged when the load carriage lift system is energized. When the lift system is deenergized the clutch engages, causing the end of the flexible member connected to the clutch output to rotate with the clutch output until there is sufficient tension in the flexible member to move the output member of the safety brake to a position wherein it trips the dog. According to one aspect of the invention the flexible member is connected between the clutch and the output member of the safety brake with a predetermined amount of slack such that the load carriage will undergo a certain predetermined amount of overtravel, say one or two inches, before the flexible member is put in tension to move the output member of the safety brake.

Other objectives and advantages of the invention will be apparent from the following description when considered in connection with the following drawings, wherein.

Figure 1:
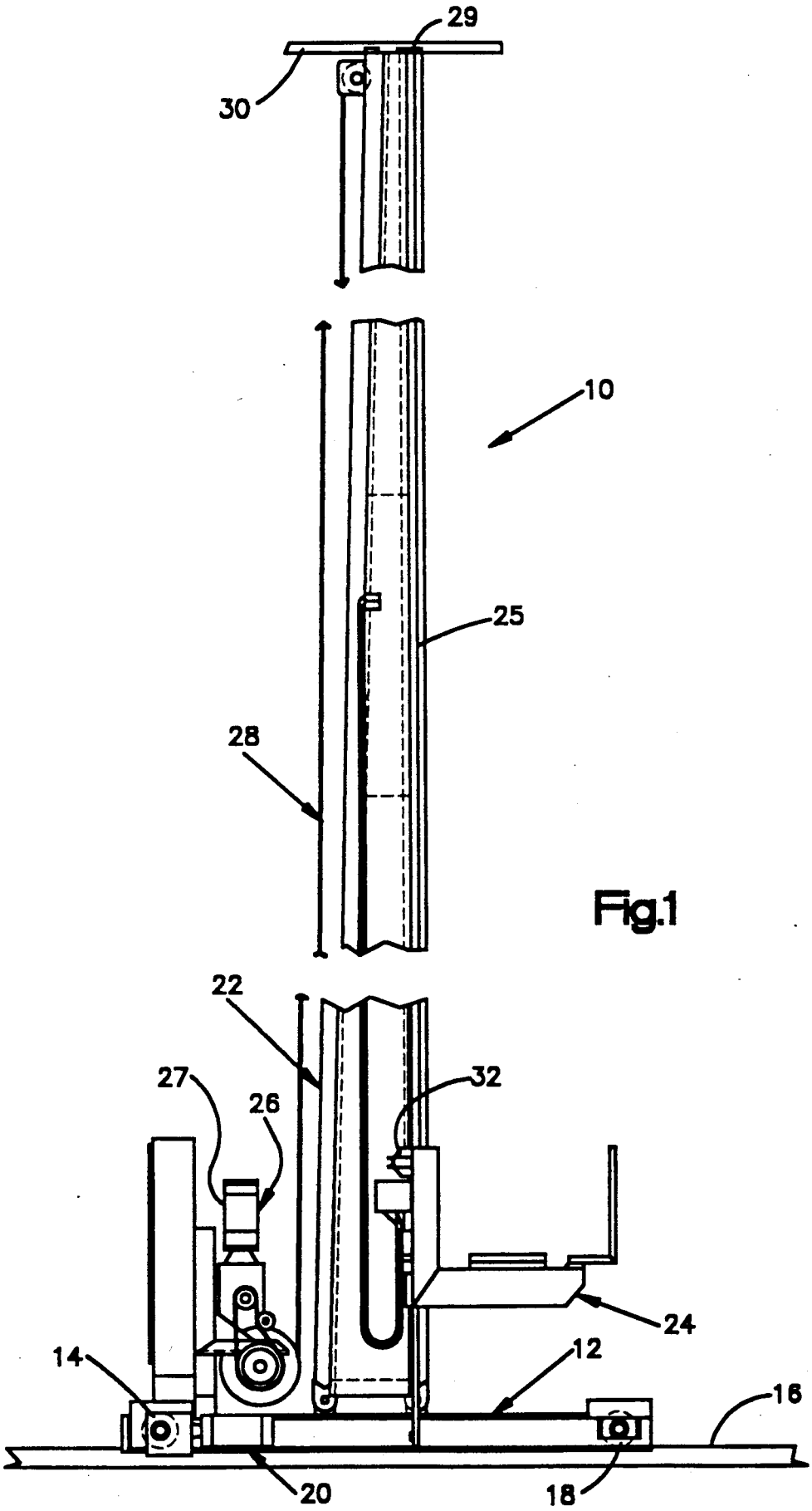
FIG. 1 is a side elevation view of a typical high rise storage and retrieval machine.

Referring to FIG. 1 there is illustrated an S/R machine 10 comprising a base assembly 12, a drive wheel 14 mounted for rotation on the frame 12 and engageable with a floor supported rail 16, an idler wheel 18 mounted for rotation on the frame and engageable with the rail 16, a drive motor assembly 20 mounted on the frame and operatively connected to the drive wheel to drive the S/R machine along the rail, a mast assembly 22 mounted to the frame, a load carriage assembly 24 mounted to the mast assembly for vertical movement along a rail 25 attached to the mast, and a vertical drive assembly 26 mounted on the frame and operable to drive the load carriage up and down the mast by means of a cable system 28. The vertical drive assembly includes a motor 27 which incorporates an internal brake (not shown) which engages automatically when power to the motor is shut off, to hold the load carriage in its stopped position. The vehicle is stabilized by means of horizontal guide wheels 29 which engage an overhead rail 30.

Figure 2:
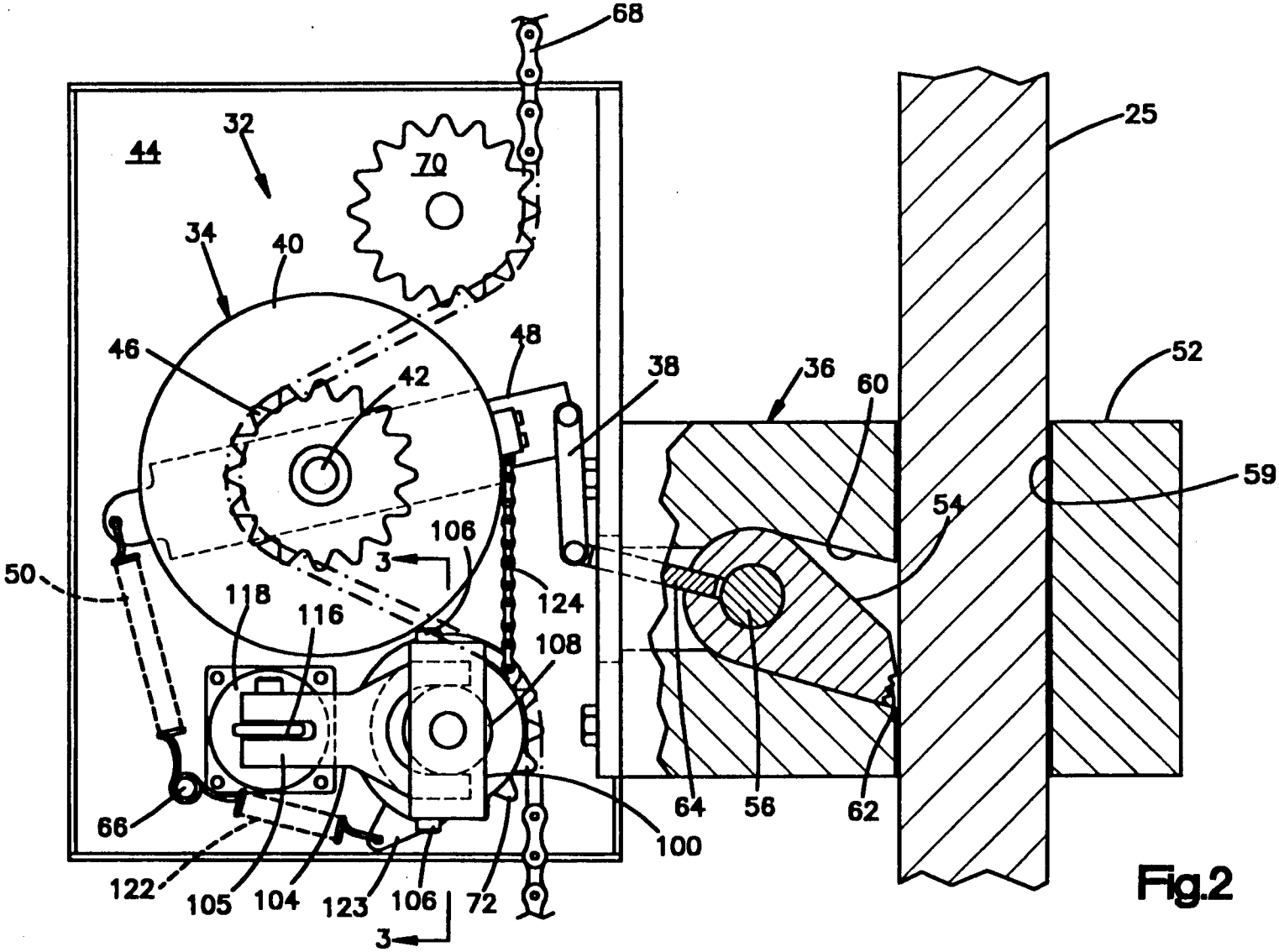
FIG. 2 is an elevation view, shown partly in section, of the invention as installed as the machine of FIG. 1.
Figure 3:
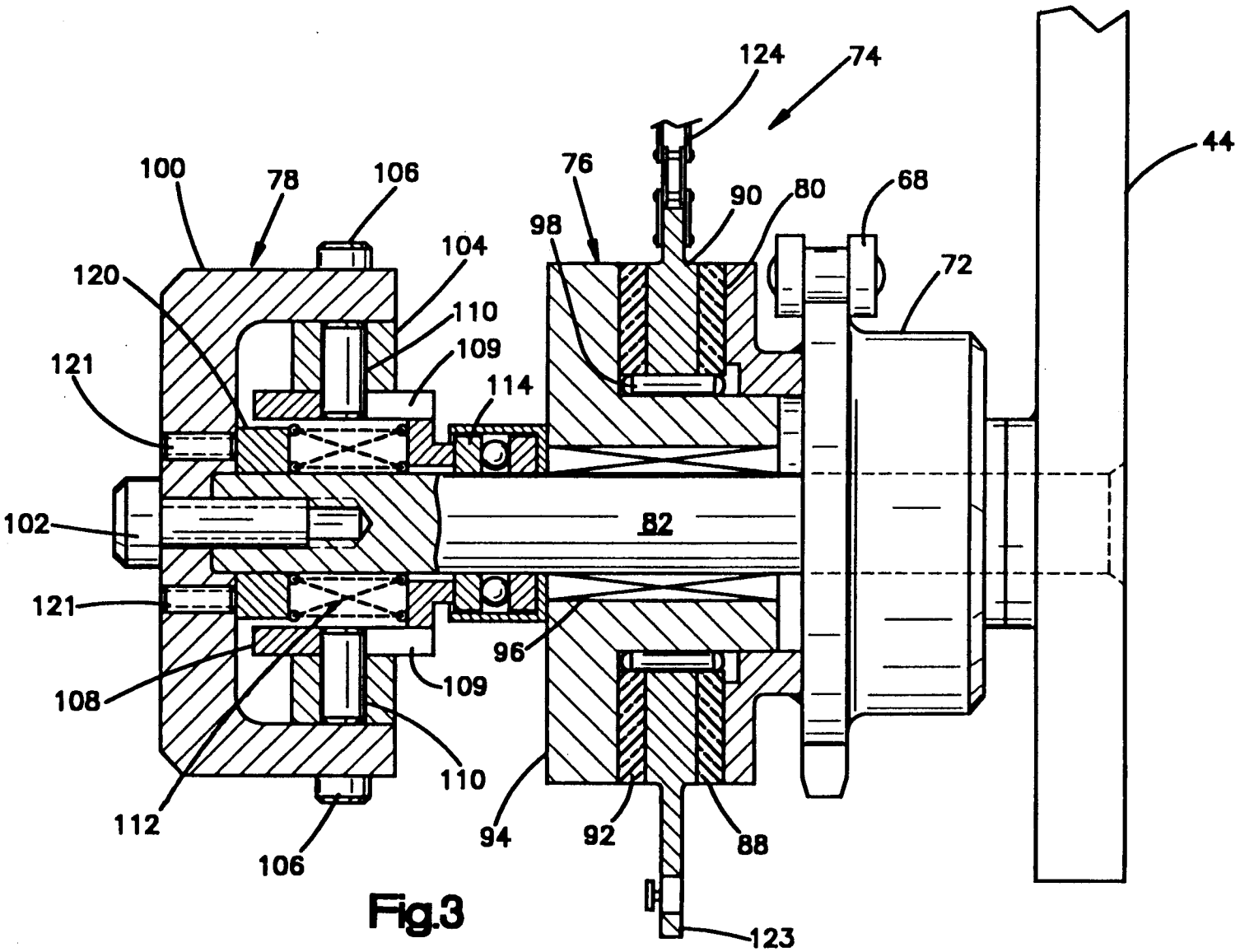
FIG. 3 is an enlarged section view taken along line 3—3 of FIG. 2.

The S/R machine includes a safety brake mechanism 32 which is mounted on the load carriage 24, and which is effective to stop downward travel of the load carriage in the event of a catastrophic failure of the vertical drive system, such as breakage of the cable 28 or total failure of the motor brake. Referring particularly to FIGS. 2 and 3, the safety brake is a well-known overspeed-sensing device comprising an overspeed sensor 34, a dog assembly 36 attached to the load carriage and engageable with the rail 25 of the mast assembly, and a link 38 connecting the sensor to the dog assembly.

The overspeed sensor 34 comprises a cylindrical housing 40 mounted for rotation on a shaft 42 fixed to a frame assembly 44 attached to the load carriage. Within the housing is a centrifugal weight assembly (not shown) which is fixed to a sprocket 46, also rotatably mounted on the shaft 42, the weight assembly including ratchet teeth which positively engage the housing when a predetermined rotational speed is reached. A bar 48 is welded or otherwise fixed to the housing for connection at one end to the link 38 and at the other end to a biasing spring 50.

The dog assembly 36 comprises a heavy block 52 attached to the frame assembly 44 and a dog 54 which is mounted for rotation on a pin 56 fixed to the block, and which is operable to engage the rail 25. The block 52 has a first rectangular channel 59 formed therein which is sized for sliding engagement with the rail 25, and a second channel 60 which is sized and contoured to receive the dog 54.

The dog 54 is configured such that when it is in the position shown in FIG. 2 its free end is slightly spaced from the rail 25. The free end of the dog has a series of teeth 62 formed therein in position to engage the rail when the dog is pivoted counterclockwise from the position shown. The end of the dog adjacent its pivot has a lever 64 extending radially therefrom for attachment to the connecting link 38. The lever can be press fit or otherwise rigidly attached to the dog.

The free end of the lever 64 is pivotally connected to one end of the link 38, and the other end of the link 38 is pivotally connected to the bar 48 to transmit rotational movement of housing 40 to the dog 54. The brake assembly is normally maintained in the position shown in FIG. 2 by the biasing spring 50 which extends between the bar 48 and a pin 66 fixed to the frame 44.

The brake 32 is actuated by means of a chain 68 which extends the length of the mast 22 and is attached at its ends to the mast, and which engages the sprocket 46. As shown in FIG. 2, the chain 68 first engages an idler sprocket 70 mounted for rotation on the frame 44, then it is routed around the sprocket 46 and then around another idler sprocket 72 which is vertically aligned with the sprocket 70. In operation, the brake assembly 32, which is attached to the load carriage, effectively rides up and down the chain, causing the sprocket 46 to rotate, along with the centrifugal weight assembly attached thereto. In a normal descent of the load carriage the centrifugal weight assembly will not rotate fast enough to cause the weight assembly to engage the brake housing 40, thus the housing will remain in the normally biased position shown in FIG. 2. If, however, the carriage descends at a sufficiently high speed to cause the centrifugal weights to engage the housing, the housing will pivot clockwise against the force of the spring 50, resulting in counterclockwise rotation of the dog 54, thus causing the free or toothed end of the dog to engage the rail 25. Once the teeth engage the rail the combination of the friction force between the dog and the bar and the geometric configuration of the dog will cause the dog to effectively become wedged into engagement with the rail upon further relative movement between them, thus preventing further movement of the load carriage along the mast.

As noted above, the above-described safety brake system is well-known and has been in service for a number of years. What the present invention provides is an actuating mechanism which adapts the safety brake mechanism for additional use as an anti-drift or anti-overtravel brake.

Referring to FIGS. 2 and 3, the overtravel brake actuating mechanism of the present invention is designated generally by the numeral 74, and comprises a clutch mechanism 76, which is operable in conjunction with the overspeed sensor mechanism 34 to cause the dog assembly to move to its engaged position, and a clutch actuator assembly 78, which is operable to actuate the clutch mechanism 76 when power to the vertical drive motor 27 is shut off.

The clutch mechanism 76 comprises a backing plate 80 welded or otherwise fixed to the sprocket 72, and thus rotatable therewith on a shaft 82 which is welded or otherwise fixed to the frame 44; a first friction disk 88, one face of which is engageable with the backing plate; a clutch disk 90 engageable with the opposite face of the first friction disk; a second friction disk 92 engageable with the opposite face of the clutch disk; and a movable hub 94 mounted for rotation and axial movement with respect to the shaft 82 on a bearing 96. The clutch disk 90 is supported for rotation on the hub on a needle bearing 98.

The clutch actuator assembly 78 comprises a substantially U-shaped clevis bracket 100 which is fixed to the shaft 82 by means of a screw 102, a release lever 104 which is pivotally attached to the clevis bracket by means of shoulder screws 106, a retractor sleeve 108 which is slidingly received on the shaft 82 and which is engageable by the release lever through pins 110, a spring pack 112 which acts between the clevis bracket 100 and the retractor sleeve to maintain the clutch assembly 74 in a normally engaged position, and an enclosed thrust bearing 114 received between the sleeve 108 and the hub 94.

Referring to FIG. 2, the release lever 104 is in the form of a yoke, the arms of which are received over the sleeve 108, and having a clevis formed at the end 105 opposite the yoke arms which engages the output member 116 of a solenoid 118 mounted on the frame 44, the output member being in a normally extended position out of the page in FIG. 2 when it is deenergized. As shown in FIG. 3, the pins 110 are received in holes formed in the yoke arms, and extend into slots 109 formed axially in the sleeve 108. The sleeve 108 is generally cup-shaped to receive the spring pack 112 which consists of a plurality of spring washers, the end washer bearing against an internal end wall of the sleeve. A spacer 120 is received between the spring pack and the clevis bracket, and is engaged by set screws 121 threaded through the bracket which are used to adjust the preload on the spring pack. As can be seen in FIG. 3 the spring pack, acting through the sleeve 108 and the thrust bearing 114, applies a predetermined axial load on the movable hub 94 which normally locks the clutch disk 90 to the sprocket 72 and thus causes the clutch disk to rotate with the sprocket. Under normal operating conditions, however, the solenoid 118 is energized whenever there is power to the vertical drive motor 27, thus the output member 116 of the solenoid is retracted into the page in FIG. 2, moving the sleeve 108 to the left in FIG. 3 as the yoke arms pivot about the shoulder screws 106. This movement compresses the spring pack and removes the axial load on the hub 94 and thus effectively disengages the clutch disk from the sprocket 72. The clutch disk is held in the position shown in FIG. 2 when it is disengaged by means of an extension spring 122 connected between the pin 66 and a tab 123 formed on the clutch disk. Accordingly, during normal operation of the S/R machine, with the solenoid energized, the clutch disk 90 will remain stationary with respect to the sprocket 72.

The clutch mechanism 76 and the safety brake 32 are linked together by means of a cable or chain 124 connected at one end to an arcuate projection of the clutch disk 90 and at the other end to the housing 40 so that counterclockwise rotation of the clutch disk 90 as shown in FIG. 2, will cause the chain 124 to initially slacken until the disk 90 rotates far enough to again put tension on the chain and thus cause housing 40 to rotate clockwise and effect actuation of the dog assembly 36 as described above. The free play or lost motion which occurs as the chain 124 initially slackens allows the load carriage to move downward slightly (e.g. 1"–2") before the dog 54 is actuated. This lost motion is provided because a certain amount of drift is permissible during normal stop and go movements of the lift carriage. It is only when this drift exceeds a certain distance such as when the lift motor is stopped for a fairly long period of time, that the present invention is expected to be effective. It can be appreciated that by varying the length and attachment points of the chain 124, the permissible drift can be varied.

It can be appreciated that although the present invention is shown in its preferred embodiment as operating in conjunction with a particular type of overspeed brake, it can be adapted to operate independently by connecting the chain 124 directly to a dog assembly such as the dog assembly 36.

I claim:

1. In a load elevating system comprising a mast, a load carriage mounted for vertical movement along said mast, drive means operable to move said load carriage along said mast and a brake system operable to prevent downward movement of said load carriage relative to said mast; the improvement wherein said brake system comprises engagement means on said load carriage engageable with said mast to prevent relative movement between said load carriage and said mast, said engagement between being movable between a first position out of engagement with said mast and a second position in engagement with said mast; actuating means operable to move said engagement means from said first position to said second position; a first rotary member on said load carriage; means operative to rotate said first rotary member in response to relative movement between said load carriage and said mast; a clutch assembly operatively engageable with said first rotary member, said clutch assembly including an output member having a first condition disengaged from said first rotary member and a second condition engaged with said first rotary member; means for selectively shifting said output member from its disengaged condition to its engaged condition; and means acting between said output member and said actuating means to move said engagement means from its first position to its second position when said output member is in its engaged condition, including means for providing lost motion connection means effective to permit a predetermined amount of relative movement between said load carriage and said mast after said output member is put in its engaged condition.

2. Apparatus as claimed in claim 1, in which said means for selectively shifting said output member from its disengaged position to its engaged position comprises means automatically actuated when said drive means is in an inoperative condition.

3. Apparatus as claimed in claim 1, in which said means operative to rotate said first rotary member in response to relative movement between said load carriage and said mast comprises substantially vertically oriented rope means attached to said mast and engaged with said first rotary member, whereby said relative movement results in rotation of said first rotary member.

4. Apparatus as claimed in claim 3, in which said rope means comprises a chain, and said first rotary member comprises a sprocket.

5. Apparatus as claimed in claim 3, in which said engagement means comprises a dog member mounted on said load carriage for pivotal movement between said first position and said second position, said actuating means comprises means for moving said dog between said first position and said second position, and said means acting between said output member and said actuating member comprises a flexible member effective to move said dog only upon a predetermined rotary displacement of said output member.

6. Apparatus as claimed in claim 5, in combination with overspeed sensing means comprising a second rotary member on said load carriage, a third rotary member on said load carriage and coaxial with said second rotary member, centrifugal means operable to interconnect said second rotary and said third rotary member when said second rotary member reaches a predetermined rotational speed, and means connecting said third rotary member to said actuating means, said flexible member being connected to said third rotary member.

7. Apparatus as claimed in any one of claims 1 through 6, in which said clutch assembly comprises a first disk fixed to said first rotary member, a second disk coaxial with the first disk and supported for relative rotary and axial movement therewith, an output disk defining said output member coaxial with and received between said first and second disks, biasing means operatively engageable with said second disk and operable to apply a clamping force between said first and second disks acting on said output disk to effectively engage said output disk with said first rotary member, and means for selectively engaging and disengaging said biasing means with said second disk.

8. Apparatus as claimed in claim 7, including a first friction disk received between said first disk and said output disk, and a second friction disk received between said second disk and said output disk.

9. Apparatus as claimed in claim 8, including a shaft mounted in a fixed position on said load carriage and extending therefrom, said first rotary member and said second disk being received on said shaft for relative movement therewith, and a bracket member attached to said shaft in fixed relation thereto outboard of said second disk; said biasing means comprising one or more spring washers received over said shaft between said bracket means and said second disk.

10. Apparatus as claimed in claim 9, in which said means for selectively engaging and disengaging said biasing means comprises a circular member received over said shaft between said biasing means and said second disk, and means engageable with said circular member for selectively applying a compressive force to said biasing means between said circular member and said bracket member.

11. Apparatus as claimed in claim 10, in which said means applying said compressive force includes a solenoid having an output element operatively connected to said circular member, said solenoid being effective to apply said compressive force when said solenoid is energized.

* * * * *